US006082747A

United States Patent [19]

Parmentier

[11] Patent Number: 6,082,747

[45] Date of Patent: Jul. 4, 2000

[54] PROCESS FOR MAKING A SNOW BOARD AND SNOW BOARD THUS OBTAINED

[75] Inventor: Alexis Parmentier, Les 2 Alpes, France

[73] Assignee: Skis Rossignol S.A., Voiron, France

[21] Appl. No.: 09/005,024

[22] Filed: Jan. 12, 1998

[30] Foreign Application Priority Data

Jan. 24, 1997 [FR] France ..... 97 01020

[51] Int. Cl.[7] ..... A63C 5/03

[52] U.S. Cl. ..... 280/14.2; 280/609

[58] Field of Search ..... 280/602, 607, 280/610, 14.2, 603

[56] References Cited

U.S. PATENT DOCUMENTS

| | | | |
|---|---|---|---|
| 4,275,904 | 6/1981 | Pedersen | 280/14.2 |
| 4,530,511 | 7/1985 | Brandt, III | 280/603 |
| 4,951,960 | 8/1990 | Sadler | 280/14.2 |
| 5,427,401 | 6/1995 | Liard | 280/602 |
| 5,538,272 | 7/1996 | Peart | 280/14.2 |

*Primary Examiner*—Richard M. Camby
*Attorney, Agent, or Firm*—Browdy and Neimark

[57] ABSTRACT

This invention relates to a snow board especially provided for high speed performance in competition.

It is slit, longitudinally and axially, at least in its front at rear parts. Furthermore, its simple flexural strength in the front and rear parts is increased by at least 20% with respect to the greatest stiffness existing at those spots for a conventional one-piece snow board, while its stiffness in the binding mounting area is rendered at least equal to the greatest stiffness existing at that spot for such a traditional snow board, and may even be greater by about 10%.

17 Claims, 6 Drawing Sheets

10
25
17
18
VI
VI
24
20
7
9
19
i i
25
24
7
i 2
3b
4b
1b
21b
i
21a
3a
4a
1a
2
4
19
20
18
7
6b
5b
5a
17
6a

PROCESS FOR MAKING A SNOW BOARD AND SNOW BOARD THUS OBTAINED

FIELD OF THE INVENTION

The present invention relates to a process for manufacturing a snow board. It also concerns a snow board obtained by this process.

BACKGROUND OF THE INVENTION

Unlike a ski or a monoski, the board for gliding over snow constituting the snow board is used asymmetrically, the user having neither his body nor his feet directed along the longitudinal axis of the board, but placed at an angle with respect thereto. The surfer's body is placed crosswise with respect to his board with either the right foot at the rear and the left foot in front, for persons with "regular foot", or the left foot at the rear and the right foot in front, for persons with "goofy foot". The distance between the feet depends on the user's morphology and essentially on his size. The toes are more or less turned towards the front of the snow board, this orientation being indicated by an angle measured from the perpendicular to the longitudinal axis of the snow board. This orientation may generally vary, for the rear foot, between 0 and 40 degrees about and, for the front foot, between 10 and 45 degrees, the position most in favour with numerous high-level surfers at the present time being the so-called intermediate position:

rear foot: angle of orientation included between 10 and 15 degrees, front foot: angle of orientation included between 30 and 45 degrees.

Be that as it may, the surfer's body is crosswise with respect to the board and to the 20 direction of his displacement. Bends are taken either by leaning forwards, towards the toes (or more simply expressed "front-side"), or by leaning backwards towards the heels (or "back-side"). The surfer's centre of gravity then moves along an axis whose orientation is substantially the bisectrix of the angle formed by his two feet.

Snow surfing is exceedingly popular at the present time, particularly among young people, with the result that snow surf competitions are now being organized, like ski competitions, and the "speed" factor is becoming essential for snow surfboards intended for competitions, and, of course, the capacity of these boards to take bends with maximum precision.

Generally speaking, a board for gliding over snow must be sufficiently rigid in order to penetrate in the snow as little as possible and therefore to slide flat at a maximum speed. On the other hand, in order to inscribe the edge line in a curve when taking a bend, this board must, on the contrary, be as flexible as possible.

These two conditions are contradictory and the whole science of snow board manufacturers consists in finding a good compromise between stiffness and flexibility which will make it possible both to move rapidly flat, while having optimum facility and precision when taking a bend.

It is an object of the present invention to overcome this difficulty and therefore to obtain a snow board which has excellent performances in speed when gliding flat and likewise excellent performances for easy and precise execution of bends.

SUMMARY OF THE INVENTION

To that end, it relates to a process for manufacturing a snow board, whose structure comprises at least:

a sole for gliding bordered, on each of its sides and over at least the whole of its supporting length, by metal edges, one or more reinforcing elements, one or more filling elements, one or more decorating elements, this snow board having a width at the level of its central part or "binding mounting area" which is included between 150 and 300 millimeters, and it being specified that the qualities of gliding and of manoeuvrability of a snow board are principally associated with characteristics of simple flexural strength of each of the areas:

of binding mounting (stiffness of binding mounting)

of front end (stiffness of tip)

of rear end (stiffness of heel)

characterized in that it consists in making this snow board with a stiffness which is, in said tip and heel ends, at least 20% greater than the greatest stiffness known at the present time for a snow board, then in slitting this snow board, in the substantially longitudinal direction, at least over its front part and over its rear part and so as to pass entirely through the thickness of the board.

This at least partially slit snow board is advantageously provided in the binding mounting area with a stiffness which is at least 10% greater than the greatest stiffness at that spot for the range of snow boards known at the present time.

The invention also relates to a snow board, characterized in that:

it is slit, in the substantially longitudinal direction and over the whole of its thickness, at least in its front part and in its rear part, and its stiffness in the front and rear parts, obtained by measuring the deflection "f" obtained by pressing on the board, with a force of 40 Kgf, applied in the middle distance between two supports supporting the board flat and placed, the first on the line of contact, front or rear respectively depending on whether it is question of the stiffness in the front part or of the stiffness in the rear part, and the other at a distance from the first, towards the rear or towards the front respectively, which is equal to:

$$(Lp/2)\times 0.55$$

(Lp being the distance, the so-called "supporting length", between the front line of contact and the rear line of contact), is given by a deflection value f less than 16 millimeters.

Advantageously, its stiffness in the binding mounting area, determined by measuring the deflection "fo" obtained by pressing, with a force of 40 Kgf, in the middle distance d between two supports supporting the board flat on either side of the middle of the supporting length Lp, and longitudinally distant from the value:

$$(Lp)\times 0.45$$

is given by a deflection value less than or equal to 35 millimeters.

Advantageously, said stiffnesses in the front and rear parts are advantageously given, under said conditions of measurement, by a deflection "f" of the order of 15 millimeters, while the corresponding stiffness in its binding mounting zone is given, under said conditions of measurement, by a deflection "fo" of the order of 35 millimeters.

For information, the stiffnesses in the binding mounting zone of conventional snow boards of the prior art are of the order of 40 to 60 mm in deflection "fo", while the stiffnesses of these snow boards at the tip and at the heel are of the order of 20 to 50 mm in deflection "f".

It should be noted that certain inventors have already proposed slitting a snow board in the longitudinal direction into two equal, removable parts, in order thus to obtain a pair of skis, enabling a T-bar to be easily taken, for example. This solution does not make it possible to solve the problem raised here, as it does not really improve the speed performances of this snow board, and, moreover, is in no way envisaged to that end.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
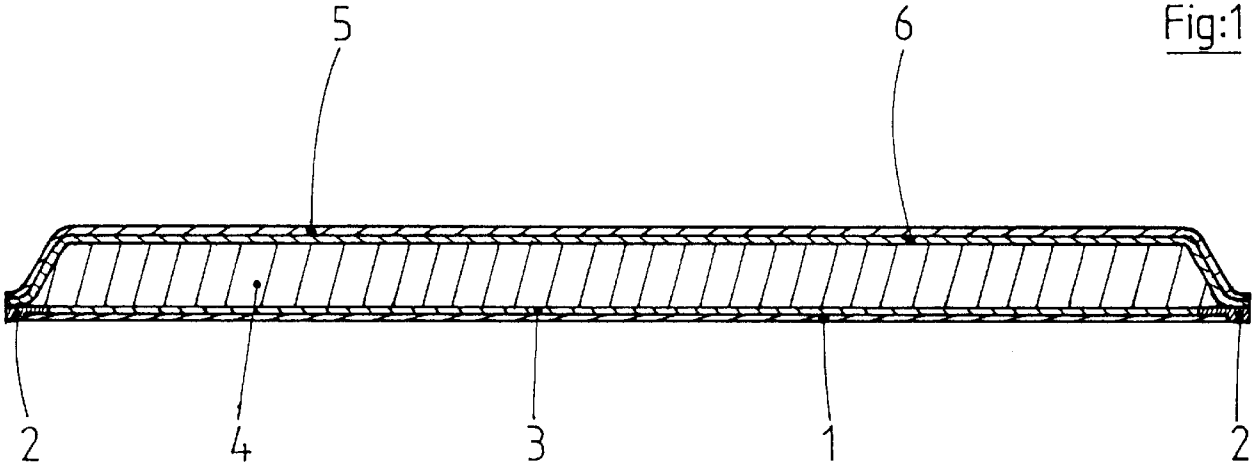
FIG. 1 shows, in cross section, an example of a conventional snow board structure.

Referring now to the drawings, and firstly to FIG. 1, a conventional snow board, of so-called "shell" type, is shown in cross section.

This snow board comprises:

- a lower sole 1 for gliding, which is bordered by metal side edges 2,
- a lower reinforcement 3 which is constituted by one or more layers of a fibrous fabric, more or less loaded with warp yarns and with weft yarns; this lower reinforcement 3 is, in the present case, placed on the sole 1 between the upper parts of the metal edges 2,
- a central core 4 which is made in the present case by injecting the compounds of a polyurethane foam but which might also be made of wood, "honeycomb", or other light material,
- an upper plastic shell 5 which is conventionally internally lined with one or more layers of fibrous fabric, these layers forming the upper reinforcement 6 of the structure of this snow board.

The width of such a snow board at the level of its central part or "binding mounting area" is in any case included between 150 and 300 millimeters.

The flexural strength of a snow board of this type, or of a similar snow board of "sandwich" structure of still more conventional type, is in practice adjusted by the manufacturer by playing on the or each inner reinforcement, such as reinforcements 3 and 6. In order to obtain more or less flexural strength, different parameters may consequently come into play: distribution in quantity of the warp yarns and weft yams in the fibrous fabrics of which these reinforcements are constituted, more or less spaced apart relationship of these reinforceing layers with respect to the neutral axis of the board, number of layers of fabric in each reinforcement, materials constituting these fabrics, total number of fibers per layer of fabric, etc . . .

It is therefore principally the reinforcing layers of fibrous material which characterize the flexural strength of a snow board and which allow it to be adjusted. This flexural strength in the direction orthogonal to the surface of glide of the board, or "simple deflection" will be referred to as "stiffness" in the present specification as well as in the claims.

Another important notion is that of the "supporting length" of a board for gliding over snow. This notion will be recalled with reference to FIG. 2.

Figure 2:
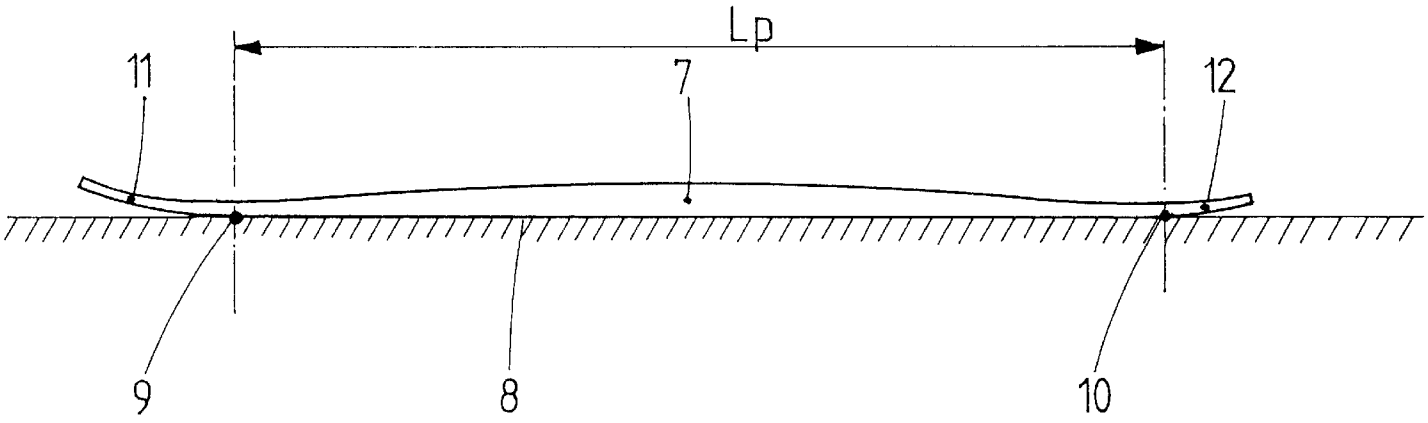
FIG. 2 is a side view of this same conventional snow board placed on a strictly flat plate.

In FIG. 2, a board for gliding over snow, such as a snow board 7, is shown applied on a strictly flat plate 8.

Under these conditions, the limits of the plane zone of contact of the sole with the plate 8 determine two transverse lines:

- a line 9 at the front of the board, where its tip 11 originates, called "front line of contact",
- a line 10 at the rear of the board, where its heel 12 originates, called "rear line of contact".

The "supporting length" of the board 7 is then defined as being the distance Lp between its front line of contact 9 and its rear line of contact 10.

Figure 3:
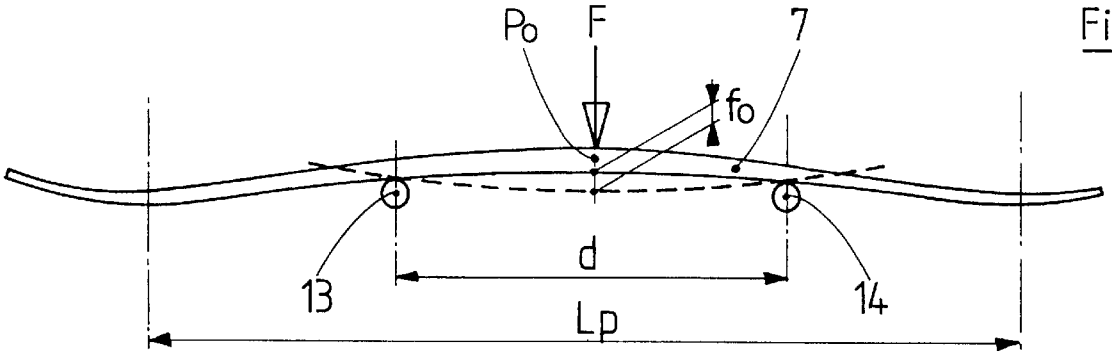
FIG. 3 shows, in side view, how the stiffness is measured in the binding mounting area of a snow board.

FIG. 3 shows how the stiffness of this snow board 7 in its binding mounting area, i.e. in its median zone, is measured.

This stiffness is measured by applying a force F in a zone Po which is located in the middle of the supporting length Lp, and which is consequently considered as being located in the middle of the binding mounting area.

The snow board 7 is then placed on two supports, for example two transverse bars 13, 14 which are disposed symmetrically and on either side of the transverse line of positioning of the force F, the distance d between these two supports being adjusted to a value:

$$d = Lp \times 0.45$$

In order to measure this "stiffness of the binding mounting area", a downward force F equal to 40 Kgf is then exerted on the board 7 at $P_0$. The board 7 then bends at that spot, between the two supports 13, 14, adopting a shape as indicated in broken lines, thus defining a deflection "fo" whose value in millimeters defines said stiffness at that spot.

Figure 4B:
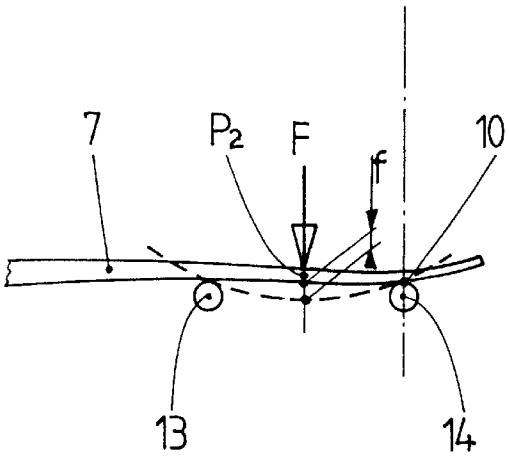
FIG. 4B shows in the same way how the stiffness is measured in the rear part.
Figure 4A:
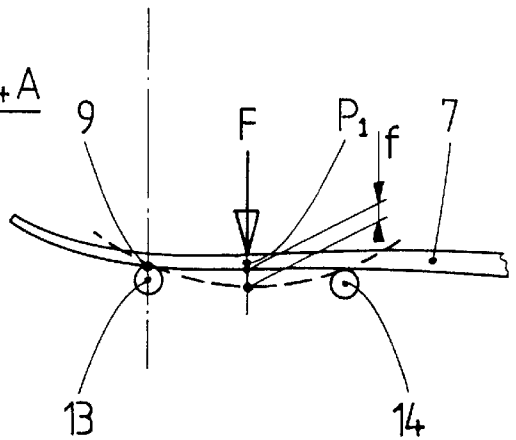
FIG. 4A is a view similar to FIG. 3, showing how the stiffness is measured in the front part of this same snow board.

FIGS. 4A and 4B respectively show how the stiffness is measured in the front part of the board 7, called "front-side stiffness", then its stiffness in the rear part, called "back-side stiffness".

The board is slid over the supports 13 and 14, with the result that support 13 is at the location of its front line of contact 9, and the support 14 is displaced to obtain a distance between the two supports 13, 14 of:

$$\frac{Lp \times 0.55}{2}$$

In order to measure the stiffness of the front part of the board, a force F of 40 Kgf is then exerted in the middle $P_1$ of the distance between these two front supports 13 and 14, and the value in millimeters of the deflection "f" then obtained for the deformation of the board characterizes the stiffness of the snow board in this front part.

According to FIG. 4B, the stiffness of the rear part of the snow board is measured in the same way, by exerting a force F of 40 Kgf in the middle $P_2$ of the distance between the two supports 13 and 14, the rear support 14 having been positioned on the rear line of contact 10 and the front support 13 being spaced apart from support 14 by the same distance as for the measurement of the stiffness in the front part, and the value in millimeters of the deflection "f" then obtained for the deformation of the board characterizes the stiffness of the snow board in this rear part.

Each of the three measurements mentioned above is, of course, effected by pressing each time on one spot only, viz. $P_0$, $P_1$ or $P_2$.

Figure 5:
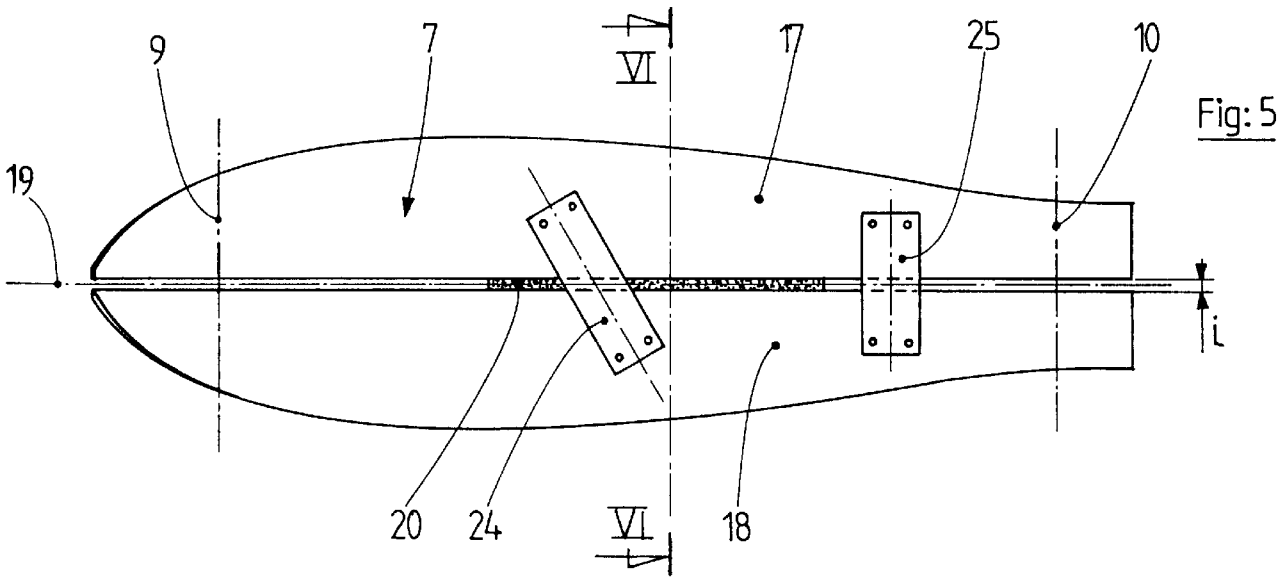
FIG. 5 is a plan view of a first embodiment of a snow board according to the invention.
Figure 6:
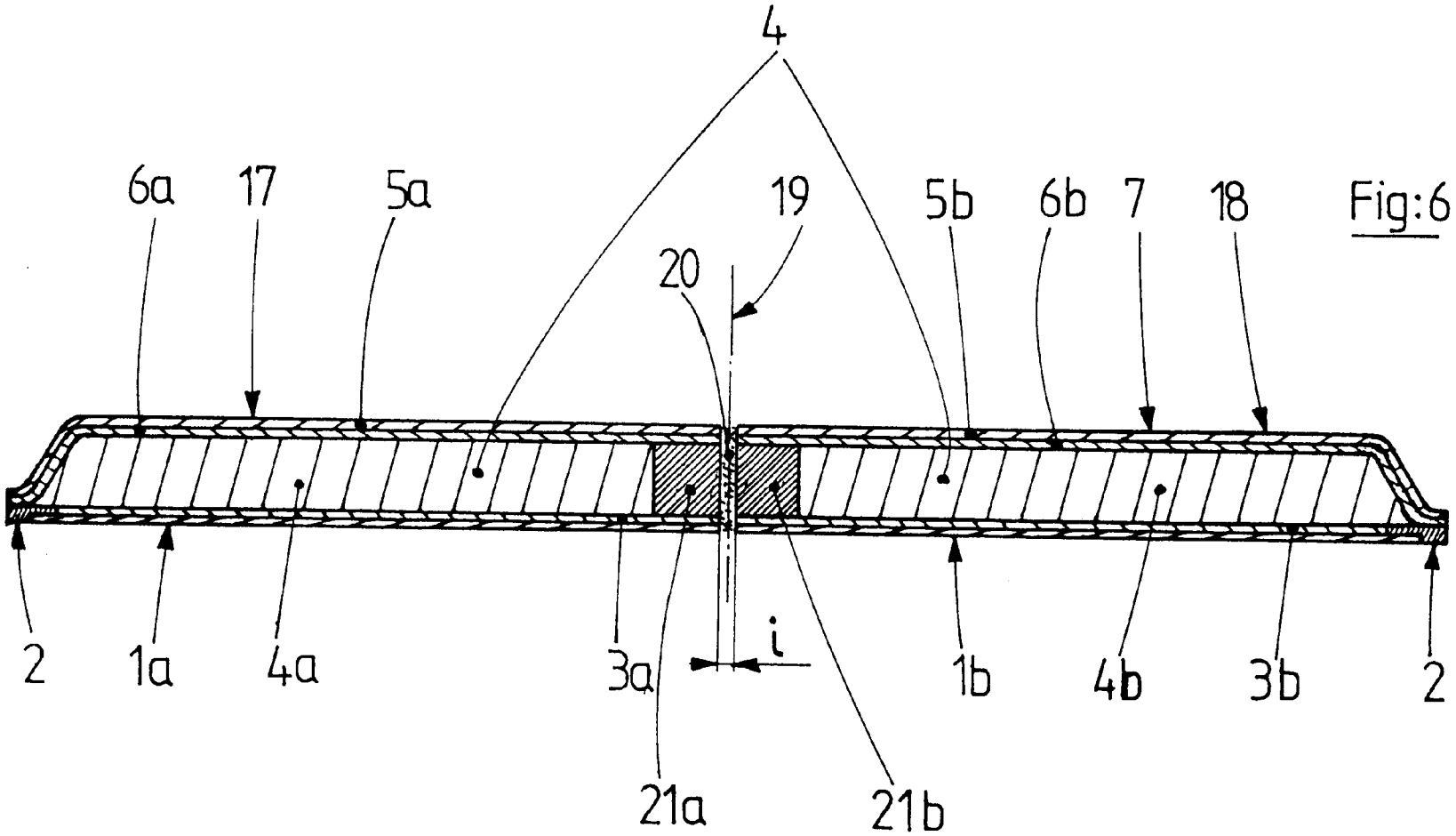
FIG. 6 is a section along VI—VI of FIG. 5.

Reference will now be made to FIGS. 5 and 6 which show in plan view and in substantially median cross section, a snow board 7 which is produced in accordance with the present invention.

This snow board 7 is not constituted by a board in one piece, but is constituted by two halves 17, 18 which are symmetrical with respect to its median longitudinal plane 19 and which are separated by a gap "i", of the order of 2 millimeters to give an idea, this gap defining for this snow board 7 a median longitudinal slit which in the present case extends from one end of the board to the other.

This gap is an air gap, except on the binding mounting area where it is filled with a supple bonding material 20, for example constituted by rubber or elastomer which is added by adhesion.

In a variant embodiment, this supple bonding material may also, or exclusively, be added in the front part and/or in the rear part of the snow board.

This axial strip 20 creates an advantageously non-removable connection between the two halves 17 and 18 and useful for avoiding infiltrations of snow.

The two halves 17 and 18 of the board 7 are further maintained fast by fixed plates 24 and 25, which constitute either the very base of the bindings of the surfer's boots, or shims for raising these bindings.

As shown in FIG. 6, the structure of this snowboard 7 comprises:

- a sole for gliding, composed here of two parts 1*a* and 1*b*,
- lateral metal edges 2,
- a lower reinforcing element, composed here of two parts 3*a*, 3*b*,
- a filling element constituted by an injected core 4, composed here of two parts 4*a*, 4*b* which are each internally bordered by a respective inner half-longitudinal element, or longeron, 21*a*, 21*b*,
- an upper reinforcing element, composed here of two parts 6*a*, 6*b*,
- a plastic shell for protection and decoration composed here of two parts 5*a*, 5*b*.

At manufacture, a longeron 21 is positioned in the axial zone of the snow board, before the core 4 is made, so that, after the slit i is subsequently cut out, the remaining core 4*a*, 4*b* is protected as shown by the two remaining half-longerons 21*a* and 21*b*.

According to the invention, the simple flexural strength of the front part and of the rear part of this snow board is rendered, at manufacture, greater by at least 20% than the corresponding greatest stiffness of a conventional snow board, taken from the whole range existing for these snow boards, i.e. constituted by a one-piece board such as the one shown in FIG. 1, while the simple flexural strength in the binding mounting area is rendered at least equal at that spot to the greatest stiffness in the binding mounting area of this same traditional snow board.

In fact, in the example in question, the stiffness in the binding mounting area of the snow board according to FIGS. 5 and 6 is provided, at manufacture, to be of the order of 10% greater than the greatest stiffness measured for the range of conventional snow boards.

Of course, as mentioned hereinabove, the different stiffnesses are adjusted by playing on the respective constitutions of the fibrous reinforcing layers 3*a*, 3*b* and 6*a*, 6*b*, and the stiffnesses are measured by the deflections fo and f mentioned above, obtained under the conditions of measurement described hereinbefore with reference to FIGS. 3 and 4.

It should be noted that the fact of slitting the snow board along "i" does not significantly modify the characteristics of stiffnesses defined hereinabove, after these stiffnesses according to the invention have been given to this board.

More precisely, by way of non-limiting numerical example:

- the stiffnesses in the front part and in the rear part of the snow board according to FIGS. 5 and 6 both correspond to a deflection f of the order of 15 millimeters, while the greated stiffness measured at these two spots for the traditional snow boards sold at the present time corresponds to a deflection of the order of 20 millimeters.
- the stiffness in the binding mounting area of this same snow board of the invention corresponds to a deflection fo of the order of 35 millimeters, while the greatest stiffness measured at that spot for the same range of traditional snow boards corresponds to a deflection fo of the order of 40 millimeters.

When a surfer takes a bend, he leans his body either forwardly, for a "front side" edge grip or rearwardly for a "back-side" edge grip.

Thanks to the invention, in an edge grip, only the corresponding board half 17 or 18 is stressed in simple bending, which considerably reduces the effective stiffness and allows a better flexion and therefore a better inscription in a bend. At the tip as at the heel, the respective spacing between the two halves 17 and 18 can then attain about ten centimeters.

The manufacturer can take advantage of the fact that only one half of the board is then stressed in simple bending, to increase the different stiffnesses as specified hereinabove, without penalizing flexion of the board in bends. Such increases advantageously lead to a clear improvement in speed performances when gliding flat, in particularly in a straight line.

In position of pure gliding, with the snow board flat, the weight of the surfer is distributed over the two parts 17 and 18 of the board. This board being in that case very rigid, the load is distributed virtually uniformly over the whole supporting surface with minimum deformation, which gives a very rapid snow board.

It goes without saying that the invention is not limited to the embodiment which has just been described.

Figure 7:
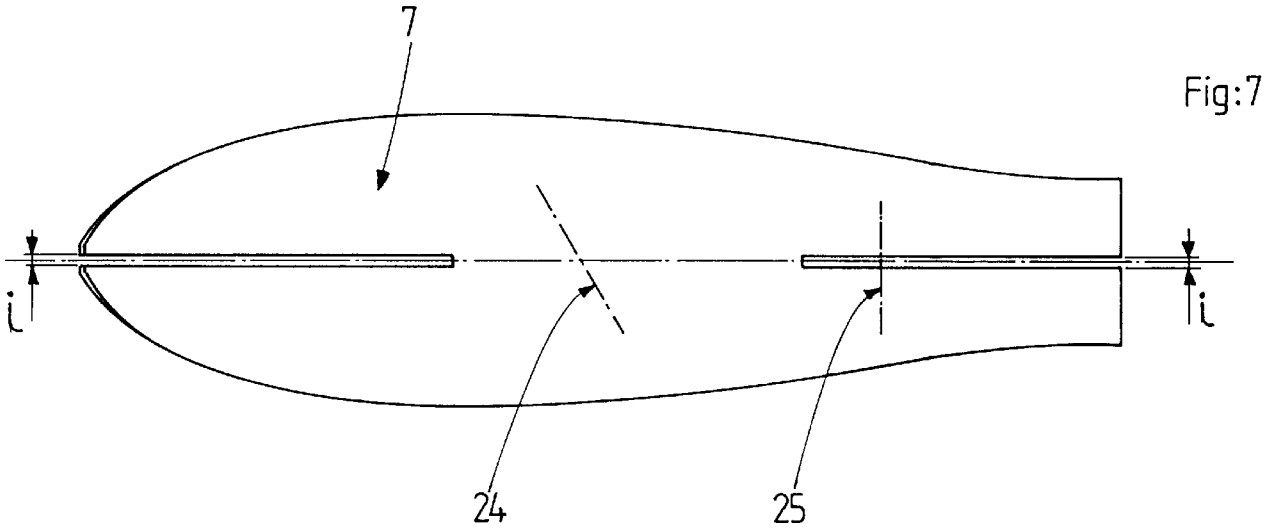
FIG. 7 is a view similar to FIG. 5, showing another embodiment of this snow board.

It is not necessary that the snowboard be slit in the binding mounting area, since this area bends little when a bend is taken, unlike the front and rear parts. In this respect, FIG. 7 shows a snow board produced like the one of FIG. 5, but which is slit along i only in its front part and in its rear part, the binding mounting area in that case being in one piece.

Figure 8:
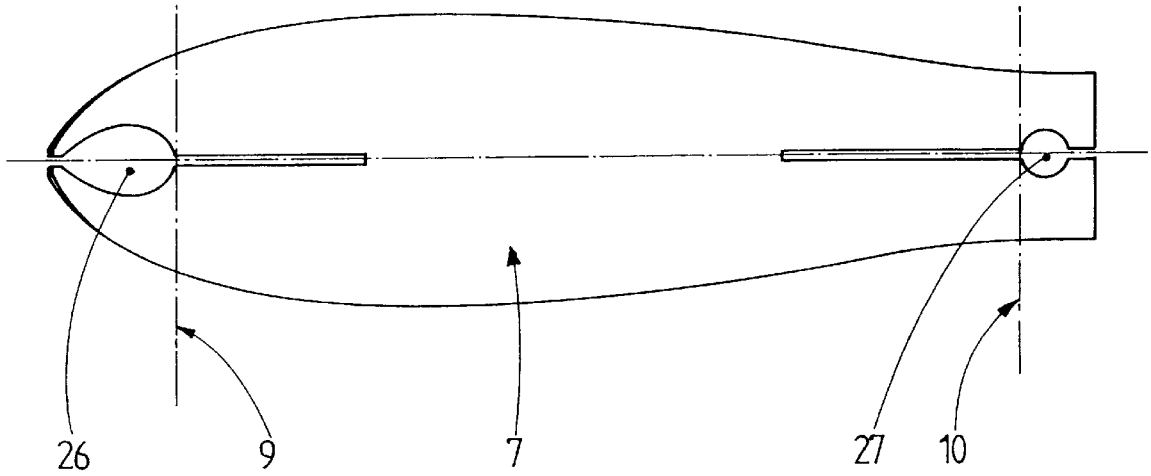
FIG. 8 similarly shows a variant embodiment of the snow board of FIG. 7.

In order to lighten the snow board to a maximum, it is also possible, according to FIG. 8, to increase the width of the slits, within said slits, in the front and/or rear part of the snow board, by transforming these slits into wide openings 27 and 27, over a determined inner length.

In that case, these inner widenings 26, 27 will preferably be made in front of and behind the front and rear contact lines 9 and 10 respectively, in order to avoid the snow accumulating on the top of the board by passing through these openings.

Figure 9:
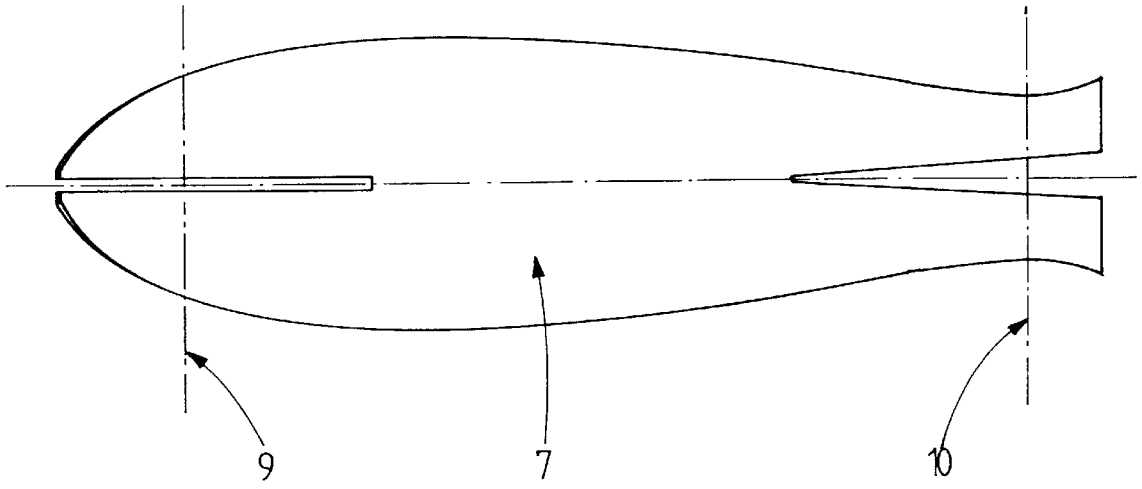
FIGS. 9 to 12 show, always in the same manner, four other variant embodiments of the snow board according to FIG. 7.

In the same spirit, the slit at the rear of the board might present a rearwardly flaring triangular shape, the rear part of the snow board in that case being in the form of a "dove-tail", as shown in FIG. 9.

Neither is it really indispensable that the longitudinal slit i of the snow board be strictly axial, strictly rectilinear, or even strictly longitudinal. On the contrary, as shown in FIGS. 10 to 12, it is possible, by no longer being subjected to one or the other of these three strict characteristics, to create for this snow board 7 a "half right/half left" asymmetry which may prove beneficial.

In fact, surfing necessarily creates, in bends, an asymmetry of efforts between the tip and the heel of each of the surfer's boots. An asymmetry of the load distribution is then created, which consequently creates an asymmetrical need for stiffness which is satisfied by the asymmetrical embodiments in accordance with one or the other of FIGS. 10 to 12.

Figure 10:
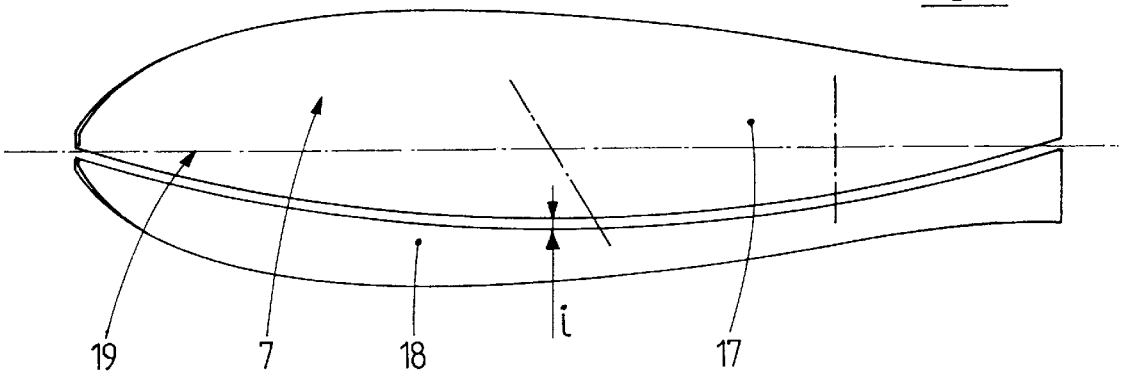

According to FIG. 10, the snow board 7 presents a slit i which is substantially longitudinal, but curved and not rectilinear, with concavity on the "back" side of the snow board. Part 17 of the board, on the front side, therefore contains more matter than part 18, on the back side.

Figure 11:
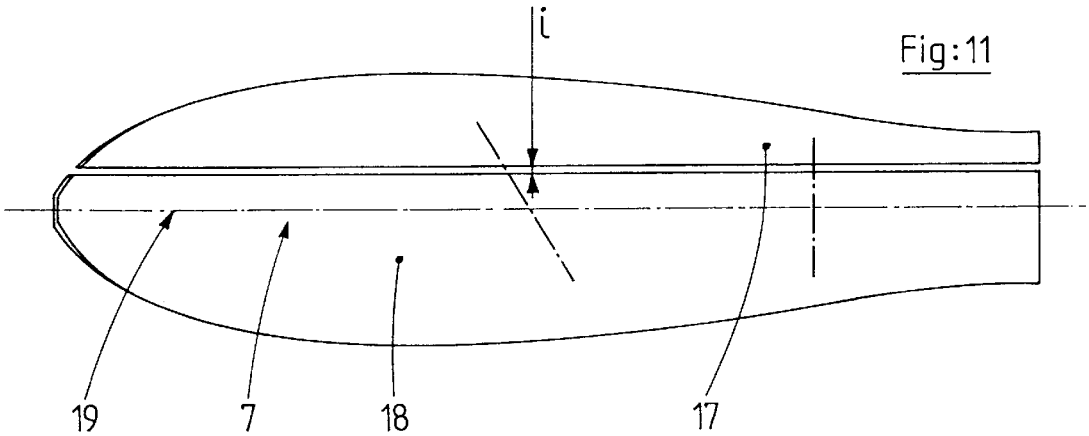
Figure 12:
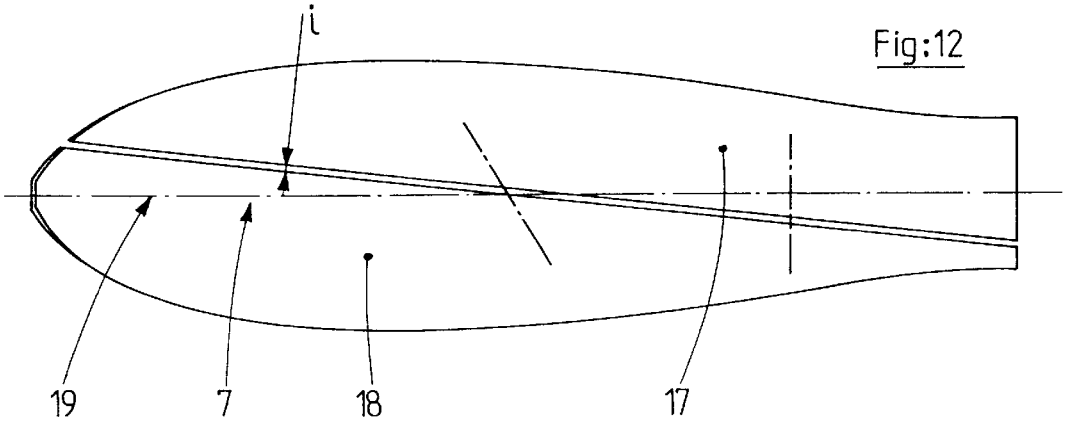

According to FIG. 11, the slit i is rectilinear and strictly longitudinal, but it is not axial: it is offset on the front side, with the result that part 17 contains less matter than part 18 and this snow board consequently presents asymmetrical reactions other than the preceding one.

According to FIG. 12, the slit i is rectilinear, but it is no longer strictly axial and longitudinal; it is slightly slanting with respect to the median longitudinal axis of the snow board 7.

The invention is, of course, in no way limited to a snow board of the "shell" type according to FIG. 6 and it is equally well applicable to a much more conventional snow board of "sandwich" structure.

What is claimed is:

1. A snowboard, of the type constituting a board for surfing on snow with the surfer's body placed crosswise with respect to the longitudinal axis of the board, this snowboard having:

a front portion comprising a front turned-up tip starting at a front line of contact, a central portion defining a binding mounting area and having a width between 150 and 300 millimeters, a rear portion comprising a turned up heel starting at a rear line of contact, a distance between said front and rear line of contact defining a supporting length Lp, a sole for gliding, a first slit through the thickness of at least the front portion, a second slit through the thickness of at least the rear portion, wherein a stiffness of the front portion and of the rear portion, is measured by the deflection f obtained by pressing on the snowboard, with a force of 40 Kgf, applied at a middle distance between two supports supporting the board flat and a first of said two supports placed on the line of contact, front or rear respectively depending on whether it is question of the stiffness in the front portion or of the stiffness in the rear portion, and a second of said two supports placed at a distance from the first, towards the rear or towards the front respectively, which is equal to:

$$(Lp/2)\times 0.55,$$

wherein the stiffness is above a stiffness corresponding to a deflection value f of 16 millimeters.

2. The snowboard according to claim 1, wherein a stiffness of the central portion, measured by the deflection "fo" obtained by pressing, with a force of 40 Kgf, in a middle distance between two supports supporting the snowboard on either side of a middle of the supporting length Lp, and longitudinally distant by the value:

$$(Lp)\times 0.45,$$

wherein the stiffness is above a stiffness corresponding to a deflection value fo of 35 millimeters.

3. The snowboard according to claim 1, wherein a stiffness of the central portion, measured by the deflection "fo" obtained by pressing, with a force of 40 Kgf, in a middle distance between two supports supporting the snowboard on either side of a middle of the supporting length Lp, and longitudinally spaced by a value:

$$(Lp)\times 0.45$$

corresponds substantially to a deflection value fo of 15 millimeters.

4. The snowboard according to claim 1, wherein a longitudinal axis of the first slit and the second slit are coaxial with the longitudinal axis of the snowboard.

5. The snowboard according to claim 1, wherein said first slit and said second slit are continuous through the thickness of the front portion, the central portion and the rear portion under the binding mounting, the binding mounting fastening together sides of the snowboard opposite the continuous first slit and second slit.

6. A snowboard according to claim 1, wherein said first slit and said second slit are not continuous through the central portion.

7. A snowboard according to claim 1, wherein said first slit and said second slit each have an inner enlargement.

8. A snowboard according to claim 6, wherein the enlargement in the first slit is located in the front turned-up tip between a first end of the snowboard and the front line of contact, and the enlargement in the second slit is located in the turned-up heel between a second end of the snowboard and the rear line of contact.

9. A snowboard according to claim 6, wherein the second slit has a triangular shape flaring towards a rear of the snowboard.

10. The snowboard of claim 6, wherein the longitudinal axis of the continuous first slit and second slit is spaced apart from the longitudinal axis of the snowboard.

11. The snowboard of claim 6, wherein the longitudinal axis of the continuous first slit and second slit is at an angle to the longitudinal axis of the snowboard.

12. The snow board of claim 6, wherein the continuous first slit and second slit is curved relative to the longitudinal axis of the snowboard.

13. The snowboard of claim 6, wherein the sides of the snowboard opposite the continuous first slit and second slit are asymmetrical.

14. The snowboard of claim 6, wherein the continuous first slit and second slit are at least partially filled with a supple bonding material.

15. A snowboard having a front portion, a central portion and a rear portion, the snow board further comprising:

a sole for gliding, a binding mounting fixed on the central portion, a first slit through the thickness of at least the front portion, a second slit through the thickness of at least the rear portion, wherein a stiffness of the front portion and the rear portion is limited to a deflection f of less than 16 millimeters.

16. The snowboard according to claim 15, wherein a stiffness of the central portion is limited to a deflection $f_o$ of less than or equal to 35 millimeters.

17. The snowboard according to claim 15, wherein a stiffness of the front portion and the rear portion is limited to 15 millimeters.

* * * * *